United States Patent [19]

Bartlett

[11] Patent Number: 4,995,453

[45] Date of Patent: Feb. 26, 1991

[54] MULTIPLE TUBE DIAMETER HEAT EXCHANGER CIRCUIT

[75] Inventor: Matthew T. Bartlett, Lexington, Ky.

[73] Assignee: Signet Systems, Inc., Harrodsburg, Ky.

[21] Appl. No.: 375,593

[22] Filed: Jul. 5, 1989

[51] Int. Cl.[5] ..... F28D 1/047; F25B 39/00

[52] U.S. Cl. ..... 165/150; 165/151; 165/912; 62/515

[58] Field of Search ..... 165/150, 151, 912, 110; 62/515

[56] References Cited

U.S. PATENT DOCUMENTS

| | | | |
|---|---|---|---|
| 1,710,579 | 4/1929 | Henshall | 165/151 |
| 1,837,442 | 12/1931 | Jackson | 165/151 |
| 2,437,452 | 3/1948 | Baird | 165/151 |
| 3,199,581 | 8/1965 | Kritzer | 165/151 |
| 3,780,799 | 12/1973 | Pasternak | 165/150 |
| 3,882,925 | 5/1975 | Huber | 165/110 |
| 4,050,881 | 9/1977 | Watson, Jr. | 165/151 |
| 4,053,014 | 10/1977 | Neff et al. | 165/150 |
| 4,089,368 | 5/1978 | Bell, Jr. et al. | 165/150X |
| 4,135,282 | 1/1979 | Neff et al. | 165/150 X |
| 4,446,915 | 5/1984 | Welch et al. | 165/150 |
| 4,520,867 | 6/1985 | Sacca et al. | 165/150 X |
| 4,549,605 | 10/1985 | Sacca et al. | 165/150 |
| 4,690,209 | 9/1987 | Martin | 165/150 |
| 4,831,844 | 5/1989 | Kadle | 165/150 |

FOREIGN PATENT DOCUMENTS

| | | | |
|---|---|---|---|
| 57-73392 | 8/1982 | Japan . | |
| 59-197799 | 9/1984 | Japan . | |
| 131989 | 6/1988 | Japan | 165/151 |

*Primary Examiner*—John Rivell
*Assistant Examiner*—L. R. Leo
*Attorney, Agent, or Firm*—DeLio & Associates

[57] ABSTRACT

A heat exchanger assembly comprises a pair of header members and a plurality of heat transfer tubes passing between the headers members. The heat transfer tubes are adapted to transfer heat between fins on the exterior of the tubes and a working fluid in liquid or gaseous phase within the tubes. A pressure drop minimizing tube passes between the headers and has a cross sectional area significantly larger than the heat transfer tubes. The pressure drop minimizing tube is adapted to carry the working fluid in a gaseous phase either as an inlet, when the heat transfer assembly is utilized as a condenser, or as an outlet, when the heat transfer assembly is utilized as an evaporator. A member connects the pressure drop minimizing tube at one end to at least two of the heat transfer tubes for condensation to a liquid, when the assembly is utilized as a condenser, or transferring gaseous working fluid from the heat transfer tubes to the pressure drop minimizing tubes, when the assembly is utilized as an evaporator. A plurality of header tubes connect the heat transfer tubes to one another to carry the working fluid through the assembly. The pressure drop minimizing tube is preferably within the heat transfer tube array and within the fin pattern imposed on the heat transfer tubes.

34 Claims, 3 Drawing Sheets

MULTIPLE TUBE DIAMETER HEAT EXCHANGER CIRCUIT

BACKGROUND OF THE INVENTION

This invention relates to heat exchangers and, in particular to a heat exchanger assembly adapted for automotive or other air conditioning evaporators or condensers and which utilizes tubes of more than one diameter within the body of the heat exchanger heat transfer surface.

Where a heat exchanger utilizes a working fluid which exists in both the gaseous and liquid phase, heat transfer performance can be limited by excessive working fluid pressure drop in those areas where the gaseous phase working fluid is found. In a heat exchanger which operates as a condenser, this problem of pressure drop occurs in the inlet section; in a heat exchanger which operates as an evaporator, it is found in the outlet section.

In a condenser-type heat exchanger, pressure drop that occurs in the inlet section reduces the saturation temperature by an amount proportional to the pressure drop. This has the effect of reducing the temperature potential driving the exchange of heat from the internal fluid to the second working fluid (e.g., air) passing over the outside of the primary and secondary surfaces. In typical applications, these surfaces are the tubes and associated fins through which the working fluid passes. Efforts which have been employed to reduce pressure drop include multiple inlet feeds and manifold assemblies, which add cost and complexity and reduce the overall assembly reliability by virtue of increasing the number of variables in the production process.

In an evaporator-type heat exchanger, excessive pressure drops in the internal fluid path on the outlet side have a similar consequence, i.e., reduction in the temperature potential available to absorb heat from the air stream passing over the exterior of the heat exchanger tubes and fins.

Furthermore, use of heat exchangers in automotive (including truck and other motor vehicles) applications, such as air conditioning systems, requires that such units be compact, low in weight and highly efficient in order to meet the increasingly restrictive specifications in modern motor vehicle technology.

Bearing in mind the problems and deficiencies of the prior art, it is therefore an object of the present invention to provide a heat exchanger assembly which minimizes the pressure drop associated with a dual phase working fluid in the gaseous phase.

It is another object of the present invention to provide a solution to the aforementioned problem of gaseous fluid pressure drop which can be utilized in both evaporators and condensers.

It is a further object of the present invention to provide a heat exchanger which meets the aforementioned objects and which is compact in configuration, low in weight and does not introduce unnecessary complexities in manufacturing.

It is yet another object of the present invention to provide a heat exchanger assembly which minimizes gaseous phase pressure drop of a dual phase working fluid which is especially suitable for use in automotive and other industrial, commercial or residential applications.

It is a further object of the present invention to provide a heat exchanger which may be utilized in various applications and which provides higher efficiencies over conventional industrial, commercial, residential or automotive type heat exchangers.

SUMMARY OF THE INVENTION

The above and other objects, which will be apparent to those skilled in the art, are achieved in the present invention which provides a heat exchanger assembly comprising a pair of header members and a plurality of heat-transfer tubes passing between the headers members. The heat transfer tubes are adapted to transfer heat between fins on the exterior of said tubes and a working fluid in liquid or gaseous phases within the tubes. A gas pressure drop minimizing tube passes between the headers through the working portion of the heat exchanger and has a cross sectional area significantly larger than the other heat transfer tubes. The gas pressure drop minimizing tube is adapted to carry the working fluid in a gaseous phase either as an inlet, when the heat transfer assembly is utilized as a condenser, or as an outlet, when the heat transfer assembly is utilized as an evaporator. A member connects the pressure drop minimizing tube at one end to at least one of the heat transfer tubes for either transferring gaseous working fluid from the pressure drop minimizing tube to the heat transfer tubes for condensation to a liquid, when the assembly is utilized as a condenser, or transferring gaseous working fluid from said heat transfer tubes to the pressure drop minimizing tube, when said assembly is utilized as an evaporator. A plurality of return bend tubes connect the heat transfer tubes to one another to carry the working fluid through the assembly.

The assembly preferably utilizes straight heat transfer tubes between the headers which are circular and have substantially the same interior cross-sectional area, and includes the pressure drop minimizing tube within the heat transfer tube array and within the fin pattern imposed upon the heat transfer tubes.

DETAILED DESCRIPTION OF THE INVENTION

The components of the present invention are preferably made of lightweight, thermally conductive material such as aluminum, although it should be noted that the high thermal efficiency and other advantages of the present invention, as compared to the prior art, are due primarily to its novel features and configuration. Other metals and alloys may also be used, for example, copper, brass and stainless steel, depending on the application. The components are joined in a conventional manner such as by welding, brazing, soldering or the like.

Among the various drawings described below, like numerals identify like features of the invention.

Figure 1:
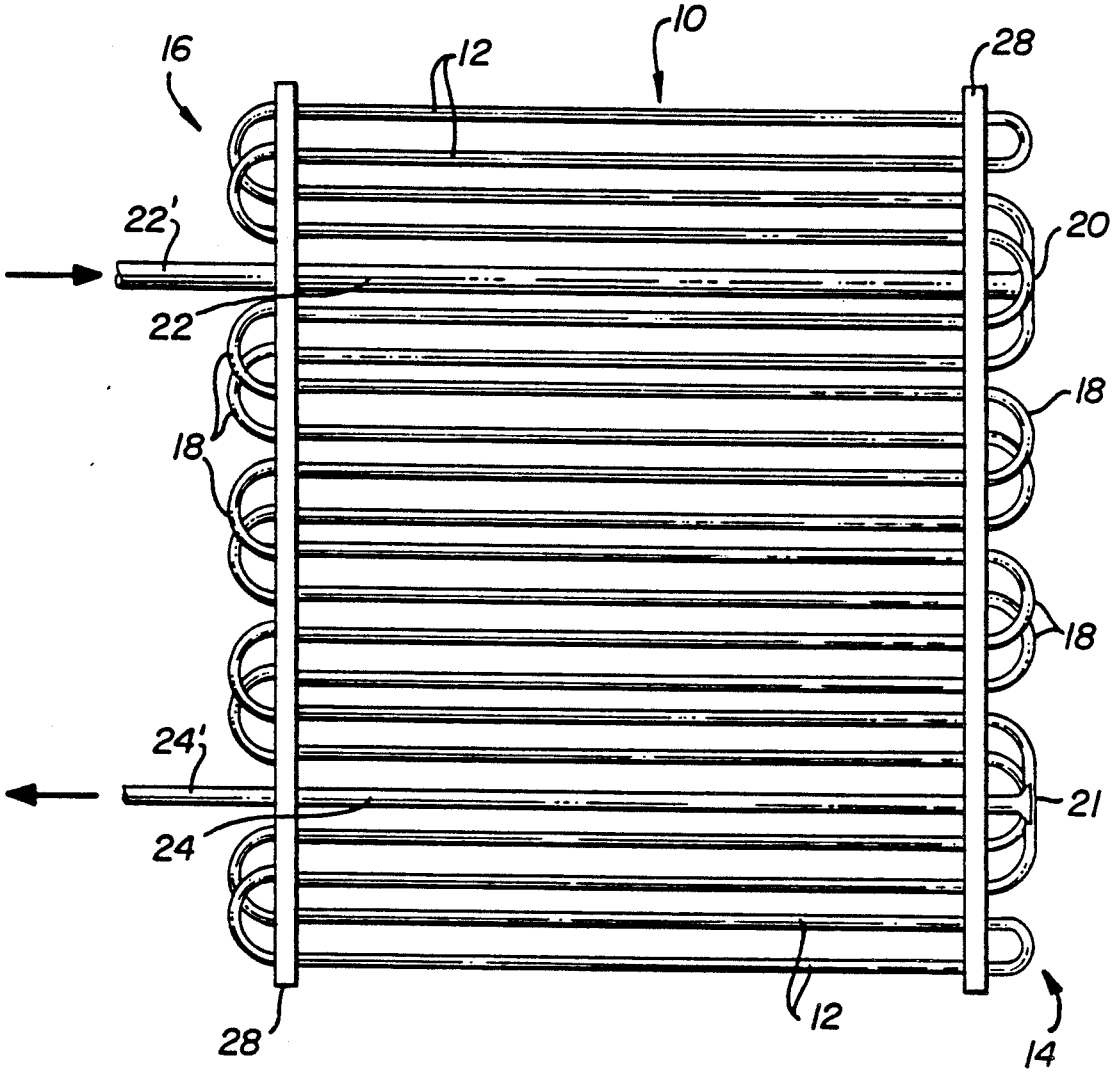
FIG. 1 is a front elevation view of the present invention, without the cooling fins, utilized as an automotive condenser.
Figure 2:
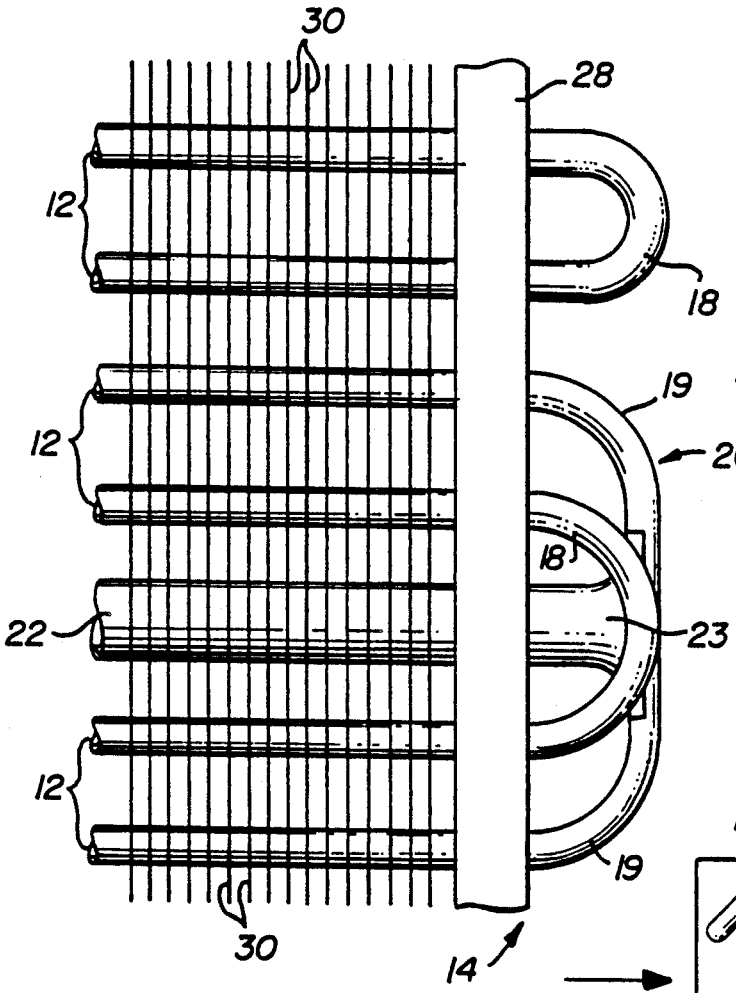
FIG. 2 is a detailed view of a portion of the front of the condenser of FIG. 1 showing the fin array on the condenser tubes.

In FIGS. 1 and 2, there are shown views of the front of the present invention in an embodiment for use as an automotive air conditioner condenser. As shown in FIG. 1, without the cooling fins installed, condenser 10 comprises a series of straight, circular cross-sectioned heat transfer tubes 12 extending horizontally and parallel between spaced vertical headers 14 and 16. Header support members 28 on either side of the condenser 10 receive the ends of condenser tubes 12. Headers 14 and 16 include header return bend tubes 18, 20 and 21 which connect the various tubes 12 and transfer the working fluid, in this case, a conventional dual-phase refrigerant, from one tube to the next. Inlet tube 22 and outlet tube 24 provide fluid connection between the condenser 10 and other components (not shown) of the automotive air conditioner unit through free ends 22' and 24', respectively.

All refrigerant enters condenser 10 through inlet end 22' and passes through the entire length of the corresponding condenser inlet tube 22 whereupon it is split into two separate fluid circuits by an "M" shaped return bend tube connecting member or pod 20 which has one inlet 23 and two outlets 19 (FIG. 2). "U" shaped return bend tubes 18, each having one inlet and one outlet, direct the refrigerant flow in each circuit from one tube !2 to the next, as shown in FIGS. 1 and 2. In the embodiment shown, the tube rows are staggered between the front and rear of the condenser. Except at the top and bottom, the header tubes connect front tubes to front tubes and rear tubes to rear tubes. The two separate fluid circuits are reunited from separate heat transfer tubes 12 by an "M" shaped return bend tube member or pod 21 which has two inlets and one outlet. The combined flow of working fluid is directed through outlet tube 24 and out through end 24' to the other portions of the air conditioner unit (not shown).

As shown in the detail of FIG. 2, an array of individual fin units 30 are shown arranged in a parallel fashion with the plane of each fin being vertically aligned perpendicular to the face of the condenser 10 and parallel to the direction of air flow therethrough. The fins 30 extend in an array and cover the entire core area of the condenser between the header supports 28. To achieve the desired convective cooling efficiencies, the fins 30 are fitted tightly over tubes 12, 22 and 24 or are otherwise bonded thereto in a manner which promotes conductive heat transfer between the tubes and the fins. Each fin 30 extends essentially completely across the depth of the condenser 10 to maximize contact with the air flowing through the unit.

A side view of the condenser 10 of FIGS. 1 and 2 is shown positioned in front of an automobile radiator 26 in a typical configuration. Air flow is shown in the direction of the arrows in FIG. 3.

Figure 3:
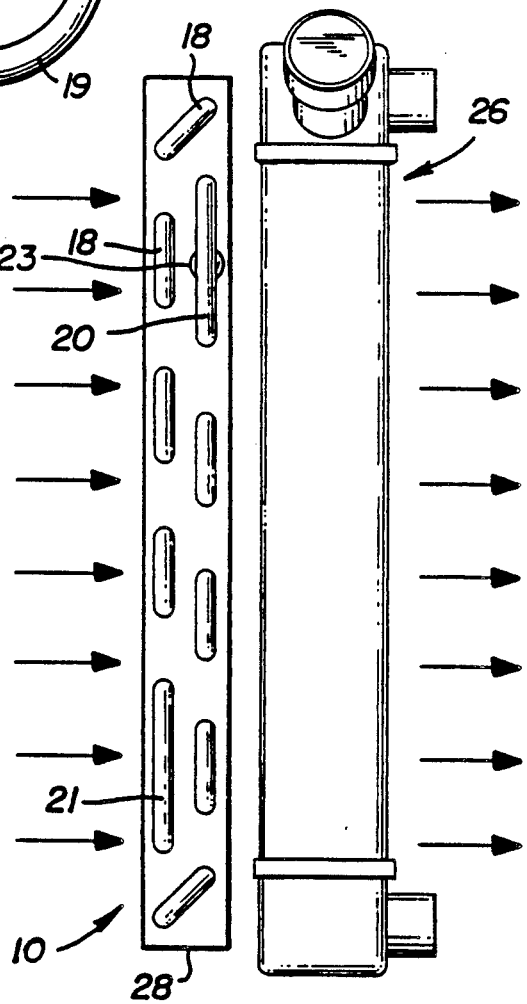
FIG. 3 is a side elevation view of the condenser of FIG. 1 mounted in front of an automotive engine radiator.

In the condenser embodiment depicted in FIGS. 1, 2, and 3, the working fluid typically enters a condenser 10 in a gaseous phase, having absorbed the heat from the passenger or other portion of a vehicle through an evaporative-type unit. To reduce the pressure drop of the incoming gaseous refrigerant, and to minimize the reduction of saturation temperature thereof, inlet tube 22, along with associated tube ends 22' and header tube inlet 23, have an internal cross-sectional area which is uniform and sized significantly larger than the cross-sectional area of the individual heat-transfer tubes 12 and outlet tube 24 in the circuits which they feed. Preferably, the internal cross sectional area of the entire pressure drop minimizing tube 22', 22 and 23 is at least about 10% larger, and more preferably at least about 15% larger, than the internal cross sectional area of the remaining tubes in the assembly. These remaining tubes 12, 18, 19, 21 and 24 all have approximately the same internal diameter and cross sectional area.

The provision of a larger internal cross-section in pressure drop minimizing tube 22 reduces the pressure drop which would otherwise be experienced in a heat transfer assembly utilizing an inlet tube having the same size as other tubes 12, 18 and 24, without elaborate manifolding or other complexities. Also, in accordance with the preferred embodiment of the present invention, the pressure drop minimizing tube 22 lies within the general pattern of tubes 12 and fins 30. In a typical application as shown in FIGS. 1–3, heat transfer tubes 12, including tube 24 and end 24', have a diameter of 0.275 in. and a wall thickness of 0.025 in. Inlet tube 22, along with tube end 22' and "M" pod inlet 23 would have a diameter of 0.375 in. and a wall thickness of 0.032 in., and is approximately 90% larger in interior cross sectional area.

Figure 4:
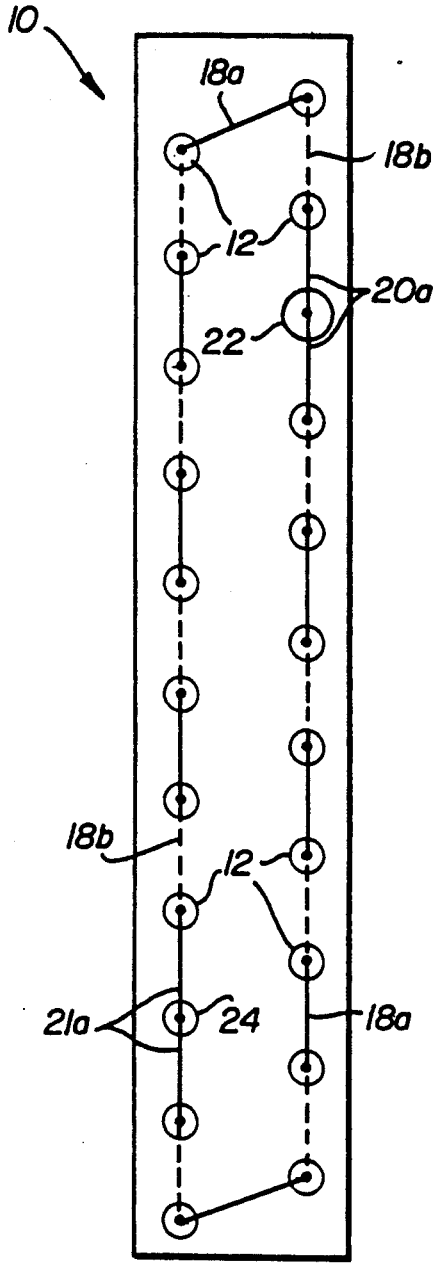
FIG. 4 is a side schematic view showing the working fluid circuit through the condenser of FIG. 3.

In FIG. 4 there is shown an end-wise "circuit diagram" of the flow path of working fluid through the various heat transfer tubes and header tubes described in connections with FIGS. 1–3. Heat transfer tubes 12, inlet tube 22 and outlet tube 24 are shown in cross section. The location of the connecting header tubes are shown connecting tubes 12, 22 and 24 in either solid line, to depict the header tubes on the near side of the condenser 10, or dashed lines, to depict the header tubes on the far side of the condenser 10. These connecting header tubes are identified by adding the letter "a" to those tubes on the near side (e.g. **18*a*) and the letter "b" to the header tubes on the far side (e.g. 18*b*) of condenser 10**.

Figure 5:
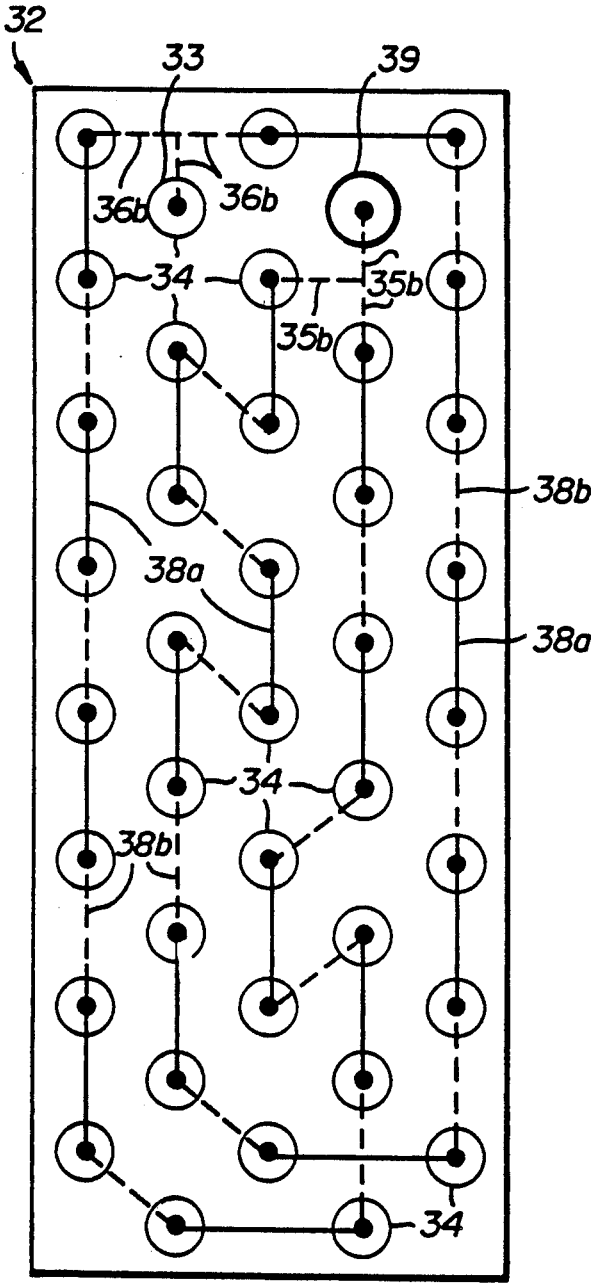
FIG. 5 is a side schematic view showing the circuit of a working fluid through an automotive evaporator constructed according to the present invention.

A side schematic of a "circuit diagram" of a preferred embodiment of the present invention as utilized in an automotive type evaporator is shown in FIG. 5. In this embodiment, the evaporator structure is basically the same as that of the condenser, except that the inlet and outlets are reversed and the configuration of the header tubes includes more rows from front to back. Evaporator 32 includes a plurality of parallel circular cross-section heat transfer tubes 34 extending in five staggered rows (front to back) between headers (not shown). Parallel inlet tube 33 serves to introduce condensed, liquid refrigerant through its near end (as seen in FIG. 5) and has the same size and cross-sectional area as the other heat transfer tubes 34. Inlet tube 33 is connected at the far end of condenser 32 (as seen in FIG. 5) by a tripod-type connecting header tube **36*b* to two other heat transfer tubes 34. The working fluid, which is divided into two separate circuits, then passes through the various heat transfer tubes and similar sized "U" shaped connecting header tubes 38*a* (shown as solid lines connecting header tubes 34) at the near end of evaporator 32 or by "U" shaped connector tubes 38*b* (shown as dashed lines connecting heat transfer tubes 34) at the far end of evaporator 32**.

After passing through the various heat transfer tubes 34 and headers 38, the two separate fluid circuits are reunited with the refrigerant in a partially or fully gaseous phase, and exit evaporator 32 the near end of outlet tube 39. In accordance with the present invention, parallel, circular outlet tube 39 is a pressure drop minimizing tube of uniform and significantly larger interior cross-sectional area than the remaining heat transfer tubes 34. A tripod-type, three-legged connecting header tube 35*b* joins the working fluid from two separate heat transfer tubes 34 at the far end of evaporator 32 into a single stream which then passes through pressure drop minimizing tube 39 and out of the evaporator at the near end. In the two-circuit embodiment shown, evaporator outlet tube 39 has an approximately 15% larger cross-sectional area than the remaining tubes 33 and 34. As in the condenser embodiment shown in FIGS. 1–4, outlet tube 39 serves to reduce the pressure drop of the gaseous refrigerant passing therethrough and thereby minimizing the reduction of temperature potential available to absorb heat from the air stream passing over the exterior of the heat exchanger.

As with the condenser embodiment, the evaporator 32 has a staggered tube configuration, as seen from the front (with five (5) rows of tubes instead of two), and has a cooling fin array imposed over the tubes 33, 34, and 39. By incorporating the pressure drop minimizing tube 39 in the fin and heat transfer tube pattern within the working portion of the heat exchanger, considerable complexity in manifolding is eliminated, thereby improving assembly reliability and lowering cost.

The evaporator embodiment depicted in FIG. 5, when utilized with an outlet tube size of $\frac{5}{8}$ in. diameter and remaining tube size of $\frac{1}{2}$ in. diameter, has shown considerably increased heat transfer over a similar evaporator utilizing an outlet tube having the same diameter as the remaining tubes. In a typical automotive evaporator assembly, the increase has been shown to be approximately 3,000 BTUs per hour.

Thus the present invention may be utilized in either a condenser mode where a partially or fully gaseous working fluid is being condensed to a liquid, or in an evaporative mode where a liquid working fluid is partially or fully vaporized to a gas. In either case, the primary tube of the heat exchanger carrying the partially or fully gaseous phase either into or out of the unit is of significantly larger cross-sectional area than the majority of the remaining tubes of the unit.

While this invention has been described with reference to specific embodiments, it will be recognized by those skilled in the art that variations are possible without departing from the spirit and scope of the invention, and that it is intended to cover all changes and modifications of the invention disclosed herein for the purpose of illustration which do not constitute departure from the spirit and scope of the invention.

Having thus described the invention, what is claimed is:

1. A heat exchanger assembly comprising:

a pair of header members;

a plurality of heat transfer tubes extending between said header members, said tubes adapted to transfer heat between the exterior of said tubes and a working fluid in liquid or gaseous phase within said tubes;

a pressure drop minimizing tube extending between said headers, said pressure drop minimizing tube having a cross sectional area larger than said heat transfer tubes and adapted to carry said working fluid in a gaseous phase as an inlet for said heat exchanger assembly;

a tube member connecting said pressure drop minimizing tube at one end to at least one of said heat transfer tubes for transferring a gaseous working fluid from said pressure drop minimizing tube to said heat transfer tubes; and a plurality of header tubes connecting said heat transfer tubes to carry said working fluid.

2. The assembly of claim 1 wherein said heat transfer tubes and said header tubes are of substantially the same cross sectional area.

3. The assembly of claim 2 wherein said heat transfer tubes include an outlet tube connected at one end to at least one other heat transfer tube and having substantially the same cross sectional area as the other heat transfer tubes.

4. The assembly of claim 3 wherein said heat transfer tubes, other than said outlet tube, are each connected at at least one end by said header tubes to only on of said other heat transfer tubes.

5. The assembly of claim 4 wherein said assembly is utilized as a condenser and has a working fluid circuit pattern connecting said outlet heat transfer tube, said other heat transfer tubes, and said pressure drop minimizing tube.

6. The assembly of claim 2 further including a convective cooling fin pattern imposed over said heat transfer tubes and said pressure drop minimizing tube.

7. The assembly of claim 1 wherein said connecting tube member connects said pressure drop minimizing tube to at least two of said heat transfer tubes.

8. The assembly of claim 2 wherein the pressure drop minimizing tube cross sectional area is at least 10% larger than the internal cross sectional area of the remaining heat transfer tubes connected by said connecting member.

9. The assembly of claim 3 wherein said pressure drop minimizing tube and said outlet heat transfer tube have free ends extending from the same header member of connecting said assembly to a working system.

10. The assembly of claim 3 wherein said assembly is a condenser.

11. A heat exchanger assembly comprising:

a pair of header members;

a plurality of heat transfer tubes of substantially the same interior cross-sectional area extending between said header members;

a plurality of convective cooling fins forming an array over said heat transfer tubes, said heat transfer tubes and fins adapted to transfer heat between the exterior of said tubes and fins and a working fluid in a gaseous or liquid phase within said tubes; and a pressure drop minimizing tube extending between said header members and within said heat transfer tube and fin array, said pressure drop minimizing tube have an interior cross-sectional area significantly larger than said heat transfer tubes and adapted to carry said working fluid in a gaseous phase as an inlet for said heat exchange assembly.

12. The assembly of claim 11 further including a tube member connecting said pressure drop minimizing tube at one end to at least two of said heat transfer tubes for transferring gaseous working fluid from said pressure drop minimizing tube to said heat transfer tubes for condensation to a liquid.

13. The assembly of claim 12 wherein said heat transfer tubes include an outlet tube connected at one end to at least one other heat transfer tube and having substantially the same diameter as the other heat transfer tubes.

14. The assembly of claim 13 further including a plurality of header tubes connecting the ends of said heat transfer tubes to carry said working fluid.

15. The assembly of claim 13 wherein said heat transfer tubes, other than said outlet tube, are each connected at at least one end by said header tubes to only one of said other heat transfer tubes.

16. The assembly of claim 13 wherein said pressure drop minimizing tube and said outlet heat transfer tube have free ends extending from the same header member for connecting said assembly to a working system.

17. The assembly of claim 16 wherein said assembly is a condenser.

18. A heat exchanger assembly comprising:

a pair of header members;

a plurality of heat transfer tubes extending between said header members, said tubes adapted to transfer heat between the exterior of said tubes and a working fluid in liquid or gaseous phase within said tubes;

a pressure drop minimizing tube extending between said headers, said pressure drop minimizing tube having a cross sectional area larger than said heat transfer tubes and adapted to carry said working fluid in a gaseous phase as an outlet for said heat exchanger assembly;

a tube member connecting said pressure drop minimizing tube at one end to at lest one of said heat transfer tubes for transferring gaseous working fluid from said heat transfer tubes to said pressure drop minimizing tube; and a plurality of header tubes connecting said heat transfer tubes to carry said working fluid.

19. The assembly of claim 18 wherein said heat transfer tubes and said header tubes are of substantially the same cross sectional area.

20. The assembly of claim 19 wherein said heat transfer tubes include an inlet tube connected at one end to at least one other heat transfer tube and having substantially the same cross sectional area as the other heat transfer tubes.

21. The assembly of claim 20 wherein said heat transfer tubes, other than said inlet tube, are each connected at at least one end by said header tubes to only one of said other heat transfer tubes.

22. The assembly of claim 21 wherein said assembly is utilized as an evaporator and has a working fluid circuit pattern connecting said outlet heat transfer tube, said other heat transfer tubes, and said pressure drop minimizing tube.

23. The assembly of claim 18 further including a fin pattern imposed over said heat transfer tube and said pressure drop minimizing tube.

24. The assembly of claim 18 wherein said connecting tube member connects said pressure drop minimizing tube to at least two of said heat transfer tubes.

25. The assembly of claim 19 wherein the pressure drop minimizing tube cross sectional area is at least 10% larger than the internal cross sectional area of the remaining heat transfer tubes connected by said connecting member.

26. The assembly of claim 20 wherein said pressure drop minimizing tube and said inlet heat transfer tube have free ends extending from the same header member for connecting said assembly to a working system.

27. The assembly of claim 20 wherein said assembly is an evaporator.

28. A heat exchanger assembly comprising:

a pair of header members;

a plurality of heat transfer tubes of substantially the same interior cross-sectional area extending between said header members;

a plurality of convective cooling fins forming an array over said heat transfer tubes, said heat transfer tubes and fins adapted to transfer heat between the exterior of said tubes and fins and a working fluid in a gaseous or liquid phase within said tubes; and a pressure drop minimizing tube extending between said header members and within said heat transfer tube and fin array, said pressure drop minimizing tube having a interior cross-sectional area significantly larger than said heat transfer tubes and adapted to carry said working fluid in a gaseous phase as an outlet for said heat exchanger assembly.

29. The assembly of claim 28 further including a tube member connecting said pressure drop minimizing tube at one end and at least two of said heat transfer tubes for transferring gaseous working fluid from said heat transfer tubes to said pressure drop minimizing tube.

30. The assembly of claim 29 wherein said heat transfer tubes include an inlet tube connected at one end to at least one other heat transfer tube and having substantially the same diameter as the other heat transfer tubes.

31. The assembly of claim 30 further including a plurality of header tubes connecting the ends of said heat transfer tubes to carry said working fluid.

32. The assembly of claim 30 wherein said heat transfer tubes, other than said inlet tube, are each connected at at least one end by said header tubes to only one of said other heat transfer tubes.

33. The assembly of claim 30 wherein said pressure drop minimizing tube and said inlet heat transfer tube have free ends extending from the same header member for connecting said assembly to a working system.

34. The assembly of claim 33 wherein said assembly is an evaporator.

* * * * *

UNITED STATES PATENT AND TRADEMARK OFFICE

CERTIFICATE OF CORRECTION

PATENT NO. : 4,995,453

DATED : February 26, 1991

INVENTOR(S) : Matthew T. Bartlett

It is certified that error appears in the above-identified patent and that said Letters Patent is hereby corrected as shown below:

In column 3, line 28, delete "!2" and substitute therefor
-- 12 --.

Column 6:

Claim 4, line 13, delete "on" and substitute therefor
-- one --.

Signed and Sealed this

Twenty-first Day of July, 1992

*Attest:*

DOUGLAS B. COMER

*Attesting Officer*

*Acting Commissioner of Patents and Trademarks*